US005547102A

United States Patent [19]

Rule et al.

[11] Patent Number: 5,547,102

[45] Date of Patent: Aug. 20, 1996

[54] PLASTIC TANK MANWAY BULGE RESTRICTOR

[76] Inventors: David D. Rule; Toby D. Rule, both of 616 S. Road 40 E., Pasco, Wash. 99301

[21] Appl. No.: 505,598

[22] Filed: Jul. 21, 1995

Related U.S. Application Data

[63] Continuation of Ser. No. 108,454, Aug. 19, 1993, abandoned.

[51] Int. Cl.[6] ..... B65D 7/42

[52] U.S. Cl. ..... 220/648; 220/649; 220/661

[58] Field of Search ..... 220/646, 648, 220/649, 661

[56] References Cited

U.S. PATENT DOCUMENTS

| | | | |
|---|---|---|---|
| 2,412,420 | 12/1946 | Parsons et al. | 220/649 |
| 3,294,271 | 12/1966 | Armbruster | 220/648 |
| 3,377,757 | 4/1968 | Magers, Jr. | 220/648 |
| 3,957,171 | 5/1976 | Besser | 220/648 |
| 4,219,125 | 8/1980 | Wiltshire et al. | 220/648 |
| 4,461,397 | 7/1984 | Portis | 220/646 |
| 5,133,475 | 7/1992 | Sharp | 220/648 |

*Primary Examiner*—Joseph M. Moy

[57] ABSTRACT

The invention is a method of preventing bulging near a sealed access door in the wall of a cylindrical plastic container. The method comprises a tension-bearing structure which wraps around the container and is forcible held away from the surface by a means which distributes the resulting force over the area of the container wall which is likely to bulge. The resulting force is higher than the force exerted by a tension-bearing structure under the same tension that is not held away from the surface. The distributed load counteracts the hydrostatic pressure within the container that would cause the container wall to bulge.

20 Claims, 7 Drawing Sheets

31
34
33
33
45
44
31

40
38
39
39
35
36
36
37
37
45
44

45
43
42
41

PLASTIC TANK MANWAY BULGE RESTRICTOR

CROSS-REFERENCE TO RELATED APPLICATION

This is a continuation of U.S. patent application Ser. No. 08/108,454 which was filed on Aug. 19, 1993 now abandoned. The earlier filing date of this application is hereby claimed.

FIELD

The invention relates to side-located hermetically sealed aperture devices which, when opened, allow the interior of a vertically situated cylindrical container to be conveniently accessed. More specifically, this invention relates to the reinforcement of thermoplastic or thermoset vessels in the area of such a sealed aperture device.

BACKGROUND OF THE INVENTION

A vertically oriented cylindrical tank that contains a liquid will have some outward pressure exerted on its walls at any point below the liquid surface. The pressure is directly related to the density of the liquid and the distance below the liquid surface.

The internal stress in the wall of a tank with a continuous side wall will be mainly horizontal tension which prevent the tank from expanding, and vertical compression which supports the weight of the tank wall. One can imagine the tank to consist of a number of hoops stacked one on top of another. Since each "hoop" is continuous, the tensile stress, which acts horizontally, is all that is needed to keep each "hoop" from expanding.

If a large hole is formed in the side of a vertical tank and then covered to prevent leakage, the tank wall to the right and left of the hole may bulge under internal pressure. Since the "hoops" which the hole passes through are not horizontally continuous, vertical components of tensile and compressive stress must exist to prevent the "hoops" from opening up around the aperture. The vertical tensile component will be largest in the segments of the tank wall adjacent to the hole on the right and left side, since the tensile stress tends to be directed tangentially around the hole in the tank. If the tank wall is so weak and the pressure is so great that the wall cannot withstand the vertical tension and the bending moment exerted on it, the tank wall will bulge.

Cylindrical, vertical tanks used for applications that require frequent manual cleaning of the inner surface, such as those used in manufacturing wine, must be equipped with a hermetically sealable access assembly, which is often referred to as a manway, on the side of the tank. This interruption in the tank wall will result in a large component of vertical tensile stress around the opening. It is desirable to manufacture the walls of a plastic tank relatively thin to minimize the amount of construction material and production time that is needed. On the other hand, thin walls are not stiff enough to prevent internal pressure from deforming the perimeter of the manway opening where the manway closure seals against the tank wall. As a result, the manway will not seal reliably and the tank will be unattractive in the bulged condition.

Thus, there is a need for a plastic tank with a thin wall, a manway, and a means of preventing the area around the manway from deforming due to internal pressure.

It is the object of this invention to fulfill this need without using protrusions or penetrating fasteners on the tank that bear a consequential load due to internal pressure.

SUMMARY OF THE INVENTION

The invention is a reinforcement system to be employed near a manway on the side of a vertically situated cylindrical tank.

The tank is a cylindrical thermoplastic or thermoset container with a hole in the side wall. The hole is closed by a manway sealing means which preferably compresses a gasket against the inner surface of the tank wall to prevent leakage. The bulge-preventing means of the invention comprises at least one steel of fiber band or other type of tension-bearing member that is circumjacent to the tank wall. To be effective, this tension-bearing member must be forcibly held away from the surface defined by the tank wall cylinder by load-distributing members at locations to the right and left of the manway hole. Thus, a force is exerted on the tank wall over the area where the load-distributing members contacts the tank wall. This force is relatively large compared to the force which would be exerted over the same area if the tension-bearing member was not held away from the surface of the cylinder. Thus, the invention exerts force at the points where it is most necessary to counteract the pressure within the tank to prevent the tank wall from bulging.

DETAILED DESCRIPTION

Figure 1:
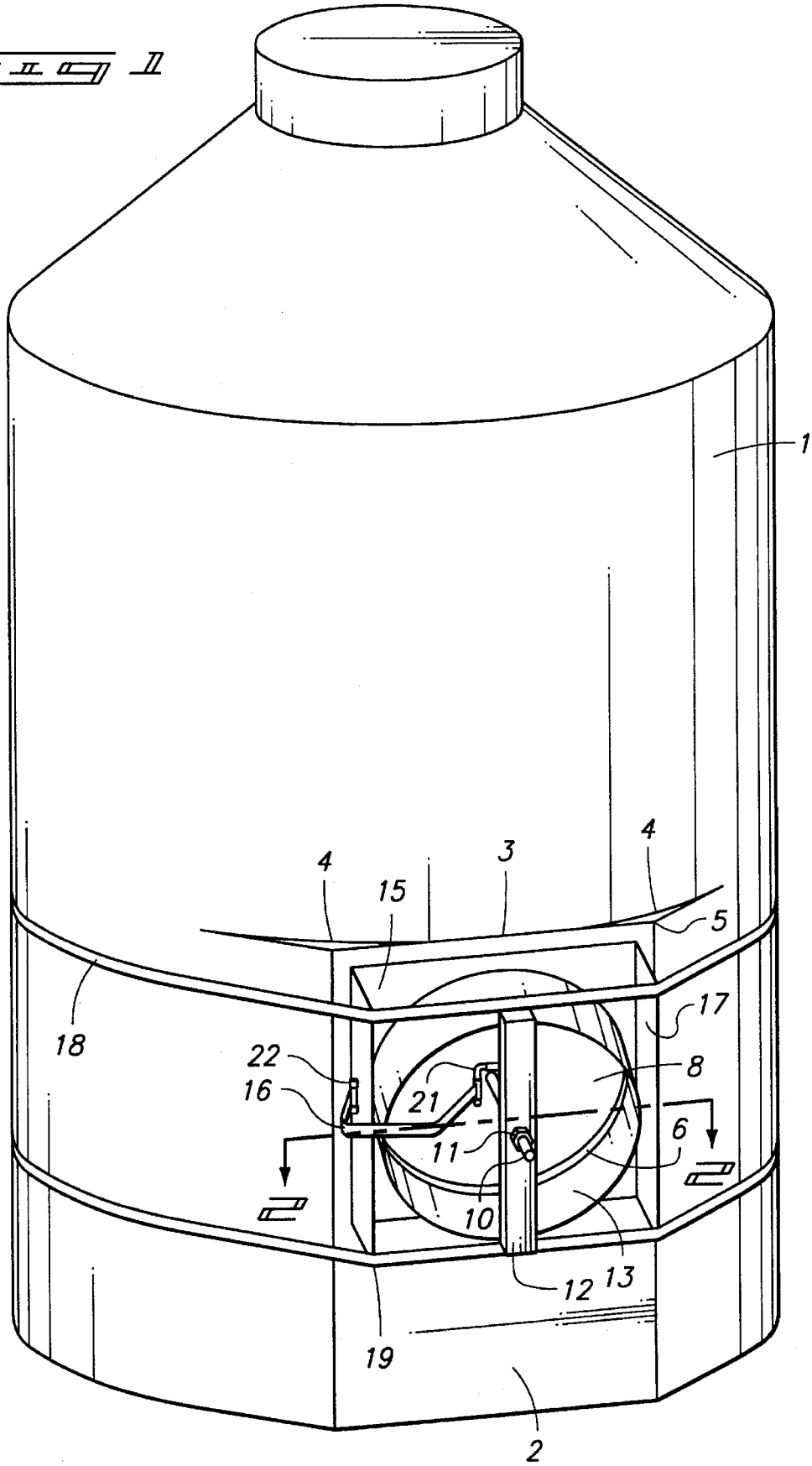
FIG. 1 is a perspective view of the preferred embodiment of the invention.

The embodiment of the invention illustrated in FIG. 1 comprises a cylindrical container 1 with its line of symmetry oriented vertically. The container sidewalls define a cylindrical surface which the sidewalls do not necessarily conform to at all points. The container defines a volume of 500 gallons, preferably more than 1000 gallons. More ideally the tank will define a volume of between 2000 gallons and 20,000 gallons.

It is preferred that the walls of the container 1 comprise high density food grade polyethylene so that they can be used for the food industry. However, the invention could be equally useful with a container comprising any of a number of thermoplastics or thermoset plastics, such as low density polyethylene, poly vinyl chloride, or fiber-reinforced resin.

Figure 2:
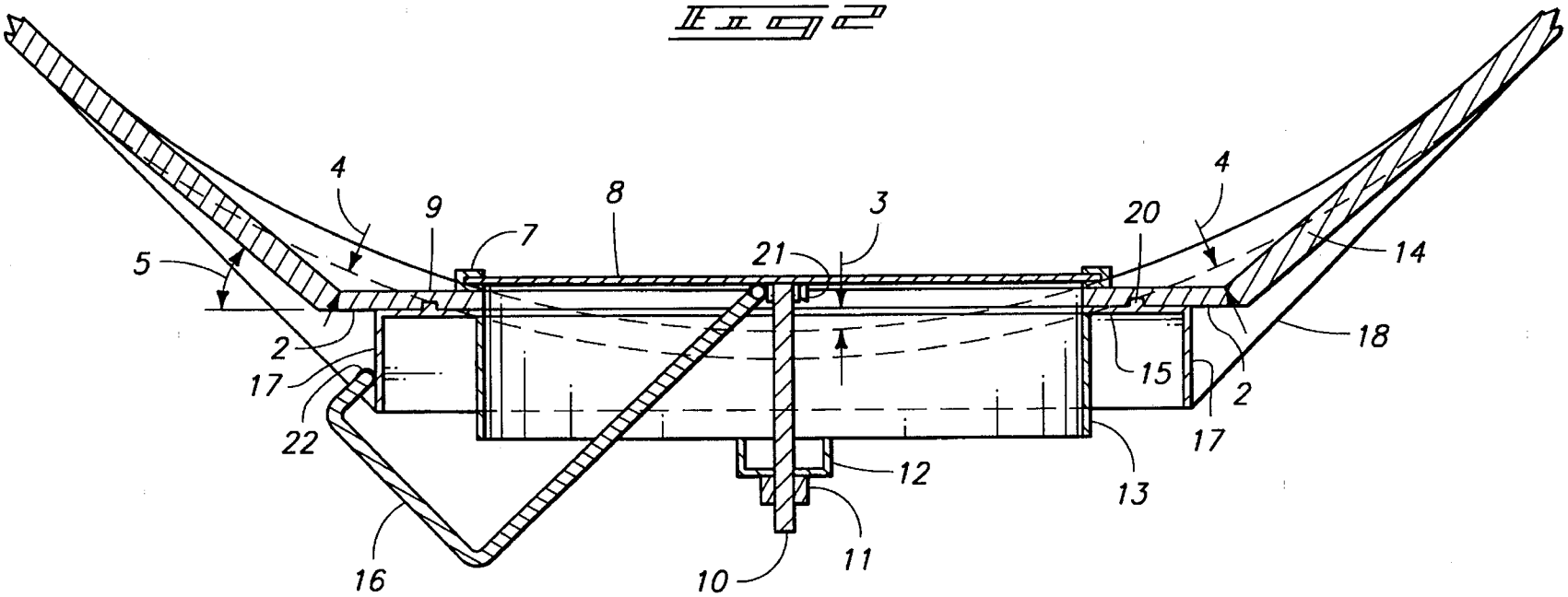
FIG. 2 is an enlarged sectional view taken along the line 2—2 of FIG. 1.

In FIG. 2, a section of the cylindrical side wall is interrupted by a planar surface 2 which extends to the base of the tank. The cylindrical surface extends beyond the planar surface the greatest distance at 3. The vertical edges of the planar surface extend beyond the cylindrical surface the greatest distance at 4. The distance at 3 should be approximately equal to the distance at 4. These distances are measured along lines normal to the cylinder's line of symmetry. The small acute angle 5 between the planes of the planar surface and the adjacent cylindrical tank wall surface results in a lower bending moment due to tensile stress. The lower bending moment keeps the planar surface from warping.

In FIG. 1, The relatively overhang of the ledge at 3 also simplifies removal of the tank from the mold after the molding process. The dimensions of the tank decrease slightly as the mold and the tank cool down following the molding process. When the tank is extracted through the base of the mold, this shrinkage allows the ledge on the tank at 3 to slide past the surface of the mold that forms the planar surface 2. Therefore, the process of extracting the tank from the mold is not complicated by the necessary removal of any section other than the flat, round base of the mold.

Thus, the equal distances at 3 and 4 provide an optimal functional balance.

In FIG. 1, There is an aperture 6 that is contained within the area of the planar surface 2 of the tank wall; the aperature 6 is shown to be approximately elliptical, but could be rectangular, round, or any other shape which allows the interior of the container to be conveniently accessed from the outside.

FIG. 2 best illustrates how the passage of the container contents through the aperture is consistently prevented by compressing a gasket 7 between a manway sealing door 8 and the inner surface 9 of the tank wall. The door 8 is drawn outward by at least one threaded stud 10 which is attached to the door 8. A threaded nut 11 draws the threaded stud 10 out through a relatively stiff member 12 which transmits the force exerted on it by the threaded nut 11 to a collar 13 surrounding the container aperature. The rim 13 is instrumental in transmitting the compressive force back to the tank wall. The rim must be thick enough and deep enough that the load on the rim is distributed evenly around its perimeter to the tank. The door is shaped so that when in the sealed position, the door perimeter will overlap the perimeter of the container wall aperture at all points. It is preferred that the door 8 and the rim 13 be made out of stainless steel that is 10 gauge or thicker. Corrosion will be resisted and wave-shaped distortions, due to compressive stress, will not form along the edge of the door when a high sealing force is applied by the threaded rod. Most of these elements are also illustrated in perspective in FIG. 1.

The planar surface is preferred so that a flat sealing door can be used, and so that the force applied to the door by the threaded rod will be distributed uniformly to all points of the gasket. It is easier to manufacture a reliable manway system using a flat, planar door.

In the embodiment illustrated in FIG. 2, the endless gasket 7 has a cross-sectional profile which wraps around the edge of the door 8. The gasket is stretched around the door so that the gasket is held in place by its own tension. It is preferred that the gasket be made of buna-n ultraviolet-inhibiting rubber. However, the invention will be useful if the gasket is made of neoprene, solid rubber, or other flexible material. This gasket must be thick and flexible enough to compress into any gaps or irregularities between the door 8 and the inner wall of the tank.

FIG. 1 shows how the rim 13 is located on a flange 15 made of stiff material. The rim should extend perpendicularly from the flange a distance which substantially increases the strength of the flange when subjected to a bending moment. This flange abuts the surface of the container wall and should be able to positively locate the rim on the planar surface 2 relative to the sealed aperture. The surface of the container should be able to conform to the abutting surface of the flange. FIG. 2 shows how the position of the flange on the planar surface will be determined by a plurality of studs 20, such as pegs or bolts, which protrude from the flange 15 and fit into a plurality of impressions in the tank wall. It is envisioned that molded features in the tank could also serve to prevent the flange from shifting its location relative to the sealed aperture. For instance, an impression in which the entire flange would rest could be molded into the tank. In the preferred embodiment shown in FIGS. 1 and 2, the rim is fillet welded to the flange in order to positively locate it over the tank wall aperture.

FIG. 1 illustrates how the manway door is guided into position by a swinging arm 16 attached near the center of the door at 21 on one end, and to the right or left side of the flange at 22 on its other end. This arrangement should allow the door to be rotated on two axes relative to the arm and the arm to be rotated on one axis relative to the flange so that the door can pass into and out of the container through the aperture. The manway can be positioned out of the way either within the tank or outside the tank so that human access to the inside of the tank is relatively unobstructed. The main purpose of this arm is to positively located the door 8 in a position where it will seal properly. Another purpose of this arm is to carry the weight of the door so that it is convenient to seal and open the manway.

The specifications for the means to seal the manway aperture are given to teach how to make and use the invention. However, the invention can be applied to any sealed aperture in the cylindrical wall of a container, where this aperture and the adjacent plastic wall of the container is likely to be exposed to internal hydrostatic pressure which would otherwise cause the wall to bulge undesirably.

Figure 4A:
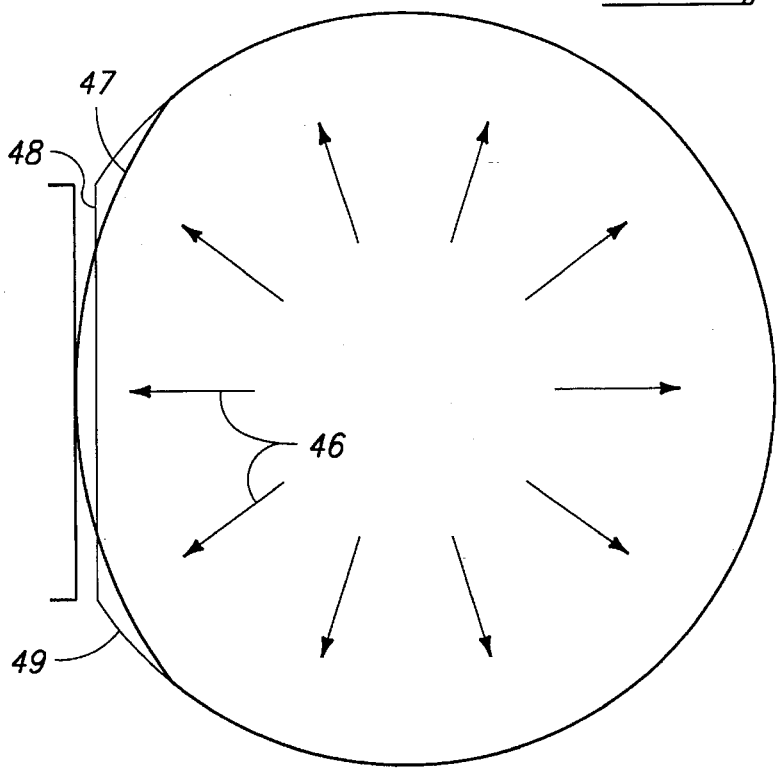
FIG. 4*a* is a schematic top view of the forces within the container which cause the sidewall to bulge.

FIG. 4*a* illustrate how the forces within the container bulge the container. When the container is filled with a fluidous material, such as a liquid or a flowing granular solid, or when the container contents are under a pressure which is greater than atmospheric pressure, the hydrostatic pressure 46 acting outward and normal to the container wall will cause the container to expand in the region of the aperature 47. In particular, the flat planar surface 48 will tend to bulge out to resemble the contour of the cylindrical shape of the tank 49. This bulging will result in a distorted gasket sealing surface and possible leakage of the contents. To prevent this distortion, pressure must be exerted inward in the vicinity of the aperature to counteract the internal pressure.

Figure 4B:
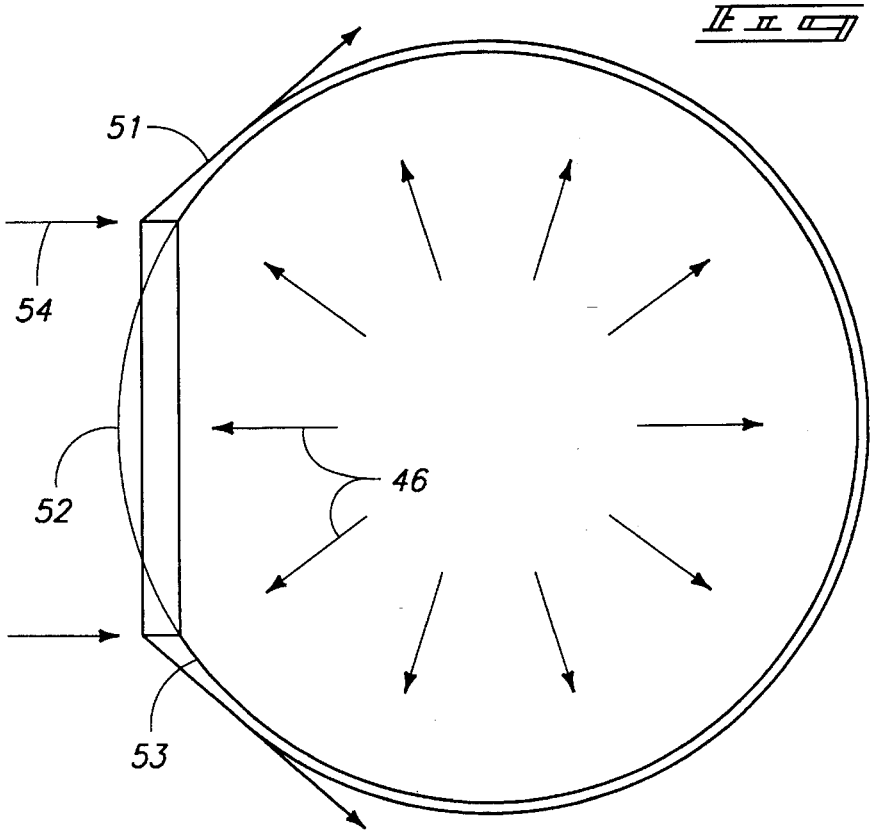
FIG. 4*b* is a schematic top view of the action of the invention in preventing container wall bulge.

FIG. 4*b* shows how container bulge is prevented. To counter the pressure, a tension-bearing means 51 is wrapped around the container and placed under tension. At points near the aperture, the tension-bearing means is forcibly held away from the cylindrical surface 52 defined by the container wall 53. Thus, a force is exerted inward 54 which counteracts the internal pressure and prevents the planar surface from bulging. The force that is thus exerted on the container wall is greater than the force which would be exerted over the same area if a tension-bearing means under the same tension was not held away from the cylindrical surface near the container aperture.

In the embodiment shown in FIGS. 1, two vertically oriented beams 17, which serve as load-bearing members, abut the right and left side of a flange 15. These beams distribute over their lengths certain concentrated pressures which are exerted on them. These beams can be manufactured by bending outward an extended length of the flange on each side. A beam could also be manufactured separately and affixed to the flange by a fillet weld. It is envisaged that any number of structures could serve as a load-bearing means, as the beam does, as long is it has some means of positively maintaining an orientation and position which allows it to bear a sufficient load perpendicular to the tank wall.

The beams, collar, and flange combine to distribute an inward load over the container wall in the area next to the sealed aperture. The beams bear the load from the bands, and the flange and the collar resist the bending moment which is exerted as the container wall attempts to conform to a more arched profile. However, a number of structural elements which could function as a load-distribution means will be obvious to one skilled in the art and science of the invention.

In the embodiment illustrated in FIG. 1, the load is exerted by two bands 18 circumjacent to the container, which act as a tension-bearing means. The bands 18 are held away from the cylinder surface at 19 by the beams 17. A force is exerted on the beams by the tension-bearing means. The beams exert a force on the flange, and finally the flange exerts a force on the container wall. The force which is exerted at point 19 where the bands act on the beams 17 is directly related to the distance of point 19 from the nearest point of the cylindrical surface defined by the container wall. This distance must be great enough that, when maximum acceptable tension is applied to the bands 18, the force is much more than sufficient to keep the hydrostatic pressure within the container from swelling the container wall in the area near the aperture. This distance can be seen most clearly in FIG. 2.

The tension-bearing means could alternately comprise bands which do not pass completely around the container on both sides of the load-distributing means, but rather connect to the container at points where the bands are tangent to the container wall. This tension-bearing means functions the same as the other embodiment in relation to the load-distributing means. The difference is that a segment of the container wall serves to bear the tension of the tension-bearing means.

Figure 3:
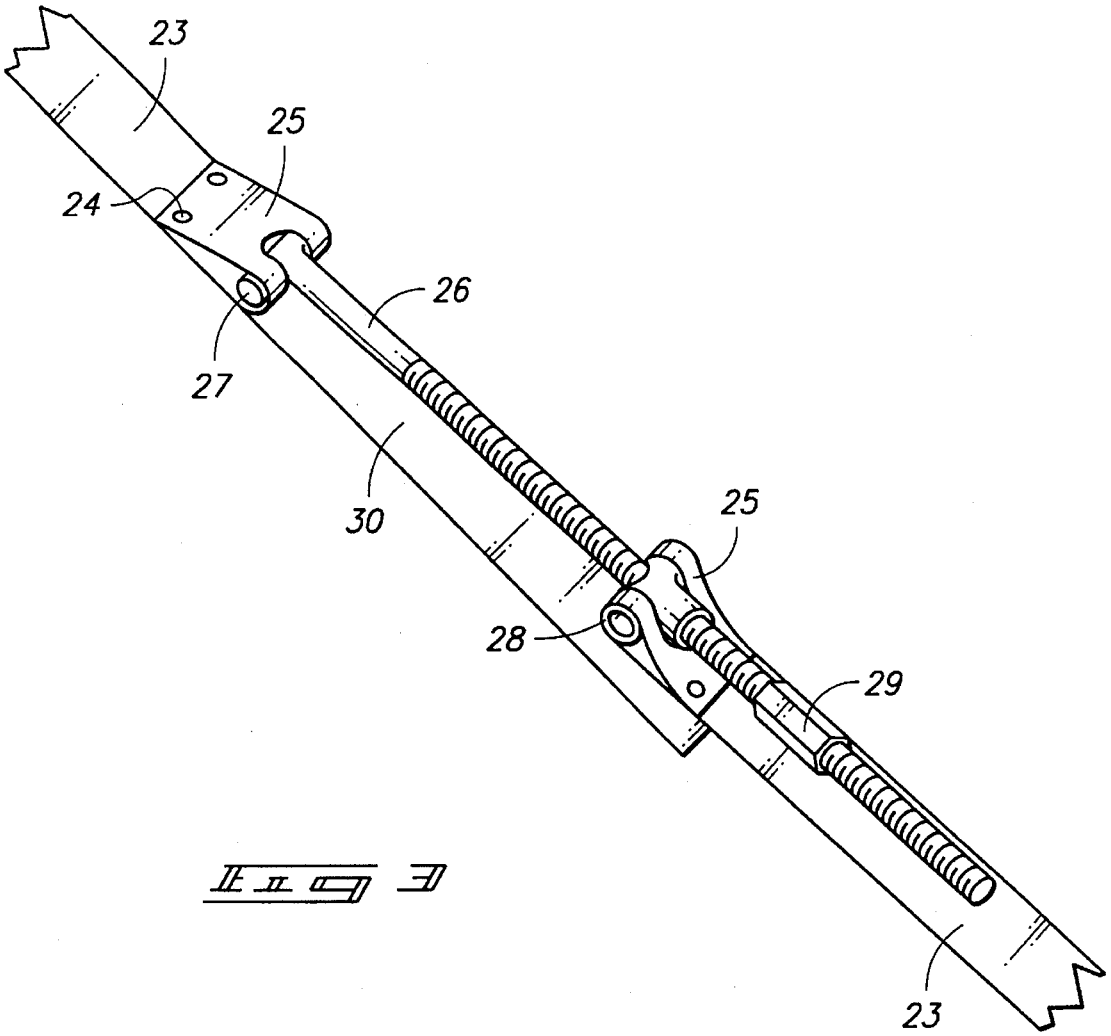
FIG. 3 is a perspective view of the manway restraining tension-adjusting means.

The tension in the bands will be adjusted by stretching the bands so that higher tensile strain will result in higher tensile stress. This shall be accomplished by a suitable tension-adjusting means. In this embodiment, each band comprises two segments 23 which are joined by a tension-adjusting means such as the one illustrated in FIG. 3. The end of each band segment has been curved over on itself and spot-welded 24 to form a loop 25. Holes have been cut in the loops as shown. A threaded rod 26 is joined perpendicularly to a shaft 27 which is held in one loop. The threaded rod 26 passes perpendicularly through a hole in a shaft 28 which is held in the adjoining loop. A threaded nut 29, which can be turned with a wrench, screws onto the end of the threaded rod 26 and draws the ends of the adjoining bands together. A short band segment 30 is attached to one of the band segment ends. The short band segment 30 is intended to prevent the ends of the band segments from damaging the tank surface as they are drawn together.

A means of varying the distance that a tension-bearing means is held away from the cylinder surface could also be used to adjust tension in the tension-bearing means. This distance would also affect the angle that the tension-bearing means makes with the container wall. This angle changes the magnitude of the component of tensile stress, relative to the tension in the tension-bearing means, which exerts a force on the load-distributing means.

This particular means of adjusting the tension of the bands is given for the purposes of describing how to make and use a preferred embodiment of the invention. It is envisioned that other tension-adjusting means may be used, such as a ratcheting lever or a hydraulic pressure system. The tension-bearing means could also be adjusted to the proper tension upon installation, so that no means to adjust that tension afterward would be necessary. It is only necessary that sufficient tension be applied to the tension-bearing means to prevent bulging which might cause seal failure or unacceptable aesthetics when the container is completely filled with its intended contents.

The tension-adjusting means must be located at a point on the tension-bearing means which is on the horizontally opposite side of the container as the aperture, or else in pairs where the members of each pair are on opposite sides of the load-distributing means and are spaced equally in distance from the load-distributing means, as measured along the cylindrical surface. This arrangement ensures that, on each side of the load-distributing means, forces of friction between the tension-adjusting means and the container wall and the tension in the tension-bearing members can be equalized.

The flange 15 must be stiff enough that it will not be warped by the forces which tend to cause the planar surface of the container to bow out to match the contour of the cylindrical shape of the tank. In this embodiment, the flange 15 is reinforced by the rim 13 which is attached to the flange by a fillet weld. The stiffness of the flange, combined with the pressure exerted by the load-bearing means, keeps the planar surface from bowing outward.

Figure 5:
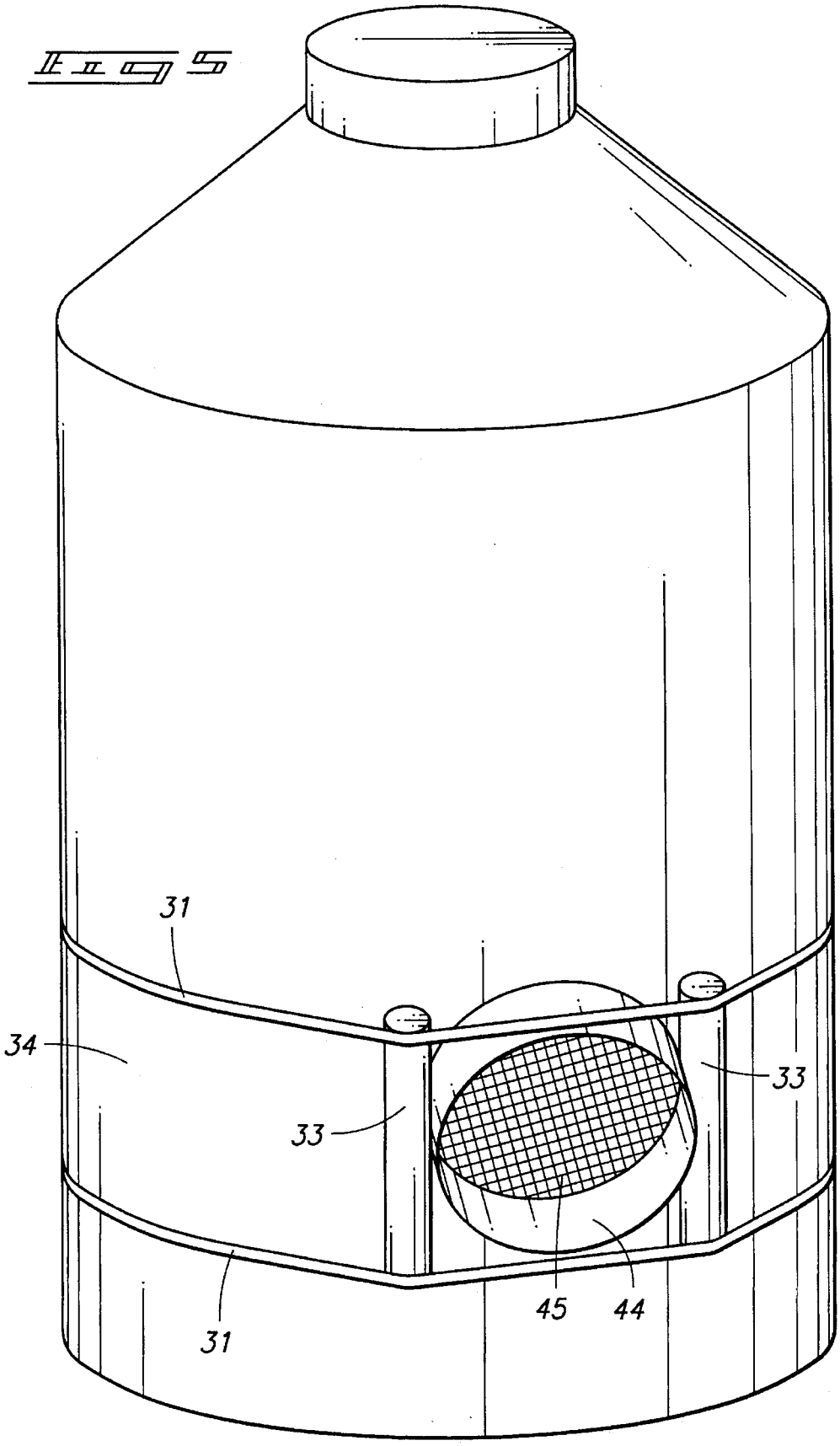
FIG. 5 is a perspective view of an alternate embodiment of the invention.

The embodiment illustrated in FIG. 5 comprises circumjacent tension-bearing means, in this case steel bands 31, a sealed aperture 45, and generally vertically-oriented load-bearing means 33 which are located immediately adjacent the sealed aperture and act directly on the wall of the container 34. Each of these load-bearing means is able to distribute over their length to the container the concentrated forces exerted by the tension-bearing means, thus serving the purpose of the load-distributing means.

Figure 6:
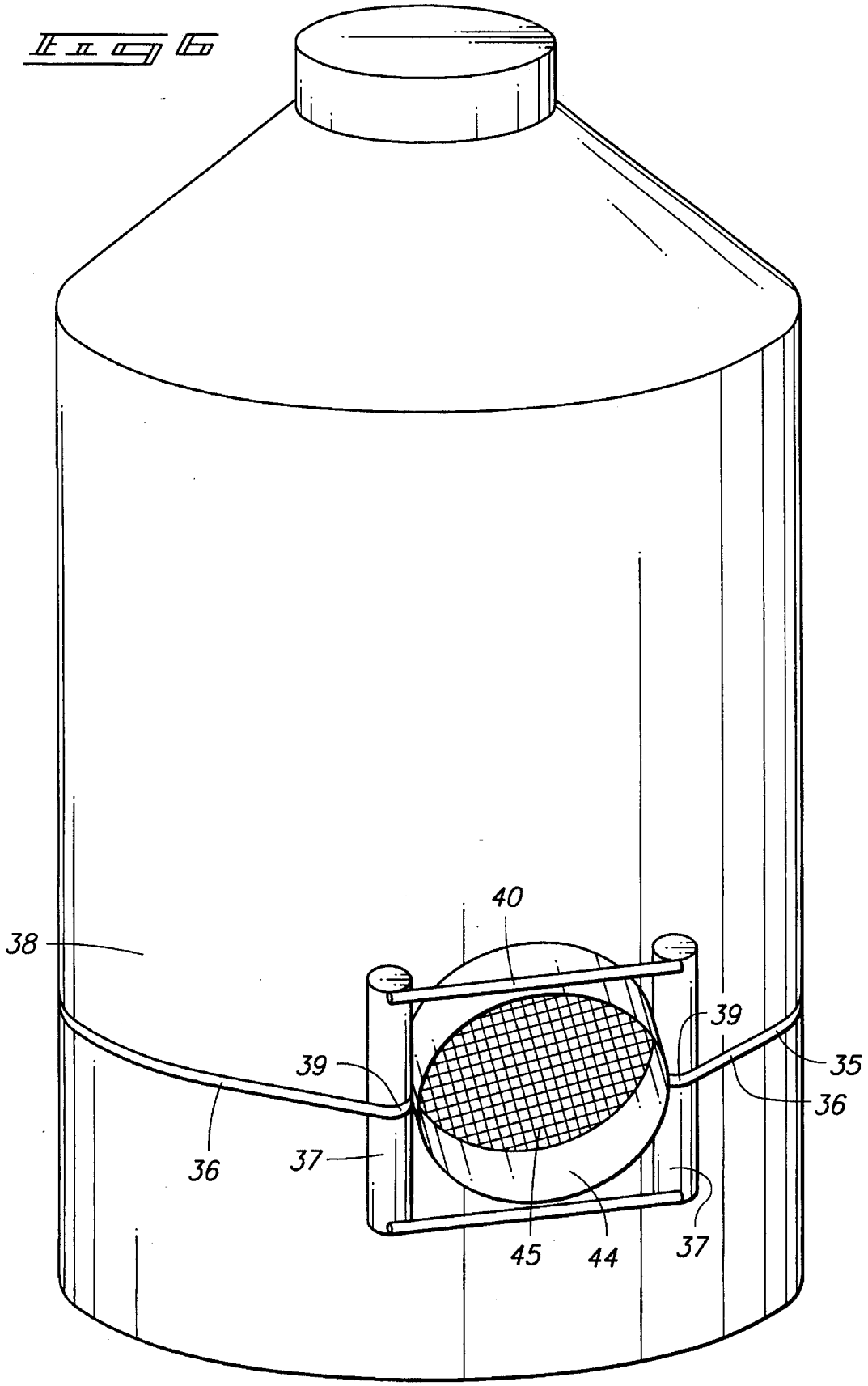
FIG. 6 is a perspective view of a second alternate embodiment of the invention.

The invention could also embody a means such as the one illustrated in FIG. 6, which comprises circumjacent tension bearing means 35 with two terminal ends 36. One of the ends attaches to one load-bearing means 37, and the other end attaches to the other load-bearing member. Each end is held away from the cylinder surface 38 by the load-bearing means 37. The point 39 where the tension-bearing means acts on the load-bearing means must extend far enough beyond the cylindrical surface defined by the container wall that a sufficient force can be exerted on the tank wall to prevent bulging.

In FIG. 6, two horizontal members 40 serve as a connecting means which spans, bears tension between and connects the load-bearing means 37 together so that a continuous tension-bearing means is formed around the container and the load-bearing means are prevented from spreading apart. No bending moment will be exerted on the points where the horizontal members connect to the load-bearing members.

The protrusion 44 illustrated in FIG. 5 and 6 is molded into the container wall, stiffens the wall of the tank adjacent to the sealed aperture 45 and positively locates the load-distributing means in a fixed position relative to the sealed aperture 45.

Figure 7:
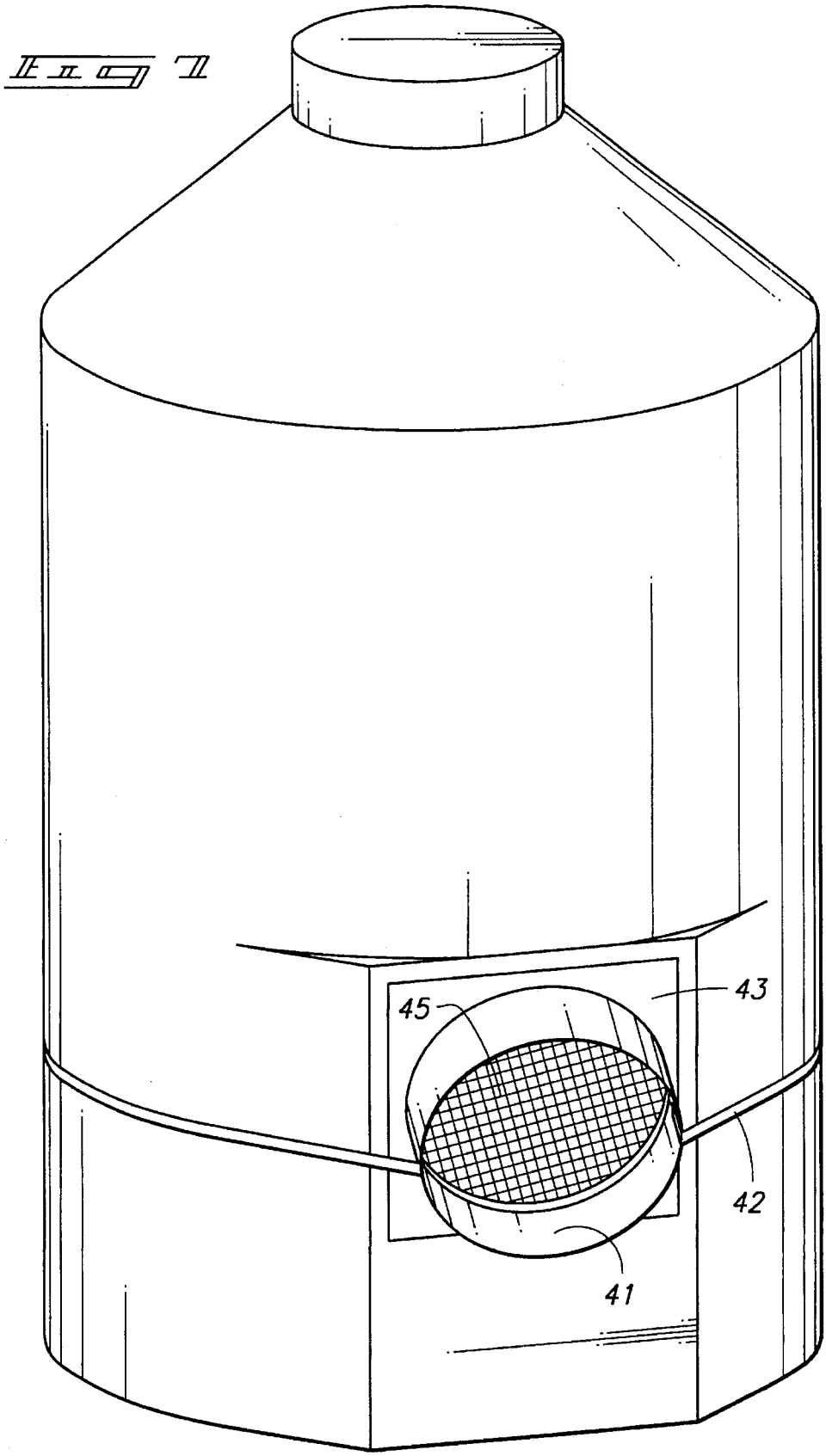
FIG. 7 is a perspective view of a third alternate embodiment of the invention.

FIG. 7 illustrates how a rim 42 around the sealed aperture could serve as a load-bearing member to which the tension-bearing means 42 would connect. This rim abuts the face of and is attached to a flange 43 which distributes the force exerted by the rim, prevents the rim from distorting due to the force exerted on it by the tension-bearing means, and positively locates the rim around the sealed aperture 45. The rim conforms closely to the shape and size of the sealed aperture which, in this case, is elliptical.

The rim in FIG. 7 cannot, by itself, carry the tension across the sealed aperture. The flange must contribute to this effect. Because the tension-bearing means and the flange do not act in the same plane, a bending moment will be applied by the tension-bearing means to the load-distributing means comprising the flange and the rim.

The present invention may also be applied to cylindrical plastic containers which are not oriented vertically and whose contents are pressurized to greater than atmospheric pressure.

We claim as our invention:

1. A means of applying pressure to prevent a vertical cylindrical container side wall from bulging near a sealed aperture, said sidewall being plastic and exhibiting a tendency to deform outwardly under stress near said sealed aperture, as when the weight of a fluidous material exerts an outward hydrostatic pressure on said side wall, said means comprising;

(a) A load-distributing means positioned adjacent to said sealed aperture and abutting the exterior of said sidewall, said load-distributing means being capable of distributing concentrated forces exerted on said load-distributing means to said sidewall in a uniform fashion, in a direction perpendicular to said sidewall, and in an area directly adjacent said sealed aperture; and (b) At least one tension-bearing means positioned circumjacent to said container wall and held away from the cylindrical surface, which is defined by said container sidewall, by said load-distributing means so that said tension-bearing means exerts an inward force on said load-distributing means that is sufficient to counteract the internal pressure that tends to bulge the area around said sealed aperture.

2. The means defined in claim 1 further comprising tension-adjusting means, wherein the tension in at least one said tension-bearing means is adjusted by at least one said tension-adjusting means.

3. The means defined in claim 2 wherein at least one said tension-adjusting means comprises a means of changing the distance said load-distributing means holds said tension-bearing means away from said cylindrical surface, so that the tension in said tension-bearing means is adjusted; and also the angle that said tension-bearing means makes with said cylindrical surface defined by said container sidewall is adjusted, which changes the magnitude of the component of tensile stress, relative to the tensile stress of the tension-bearing means, which exerts a force on said load-distributing means.

4. The means defined in claim 2 wherein at least one said tension-bearing means comprises one said tension-adjusting means which is located on said tension-bearing means at a point on generally the opposite side of said container from said load-distributing means, so as to equalize the tensile stress on each side of said tension-adjusting means due to friction between said container side wall and said tension-bearing means.

5. The means defined in claim 2 wherein at least one said tension-bearing means comprises at least one pair of said tension-adjusting means which are located at points along said tension-bearing means such that the shortest distance, measured along the surface of said tank, from said load-distributing means to each member of a said pair is equivalent, so as to equalize the tensile stress on each side of said tension-adjusting means due to friction between said container side wall and said tension-bearing means.

6. The means defined in claim 1, wherein said load-distributing means comprises two load-bearing means and a flange, said load-bearing means being oriented vertically, located adjacent to and to the right and left of said sealed aperture, abutting the face of said flange and holding said tension-bearing means away from said surface defined by said container cylinder, said load-bearing means distributing force exerted by said tension-bearing means to said flange, and further to said container wall, so that said force is sufficient to counteract the internal pressure which tends to bulge the area around said sealed aperture.

7. The means defined in claim 6 wherein said load-distributing means further comprises a rim which borders and approximates the shape of the perimeter of said sealed aperture and extends perpendicularly from said flange, said rim being attached to said flange and extending a distance perpendicularly from said flange which substantially increases the strength of said flange when subject to a bending moment.

8. The means defined in claim 6, wherein said flange defines a planar surface which abuts a surface section of said side wall, said surface section able to conform to the planar profile of said flange.

9. The means defined in claim 1, wherein at least one said tension-bearing means passes continuously over said load-distributing means.

10. The means defined in claim 1 wherein at least one said tension-bearing means attaches to said load-distributing means, so that said load-distributing means is placed in tensile stress.

11. The means defined in claim 10 wherein at least one said tension-bearing means also exerts a bending moment on said load-distributing means.

12. The means defined in claim 1 wherein a plurality of studs extend from the load-distributing member, and said container wall comprises a plurality of impressions into which said studs fit, thus preventing said load-distributing means from shifting its location relative to said sealed aperture.

13. The means defined in claim 1 wherein features molded into said container wall serve to positively locate said load-distributing means in a fixed location relative to said sealed aperture.

14. The means defined in claim 1 wherein at least one said tension-bearing means attaches to said container wall so that a segment of said container sidewall bears the tension of said tension-bearing means.

15. The means defined in claim 1 wherein said load-distributing means comprises a flange which abuts said container sidewall and fits over said sealed aperture while still allowing access to said sealed aperture; and a rim which extends outward from, and abuts the face of, said flange, said rim conforming close to the perimeter of said sealed aperture, said rim serving to hold said tension-bearing means away from said cylindrical surface defined by said container wall, said tension-bearing means exerting force on said rim, said rim distributing said force on said flange, and said flange distributing said force to said container wall, so that said container wall will not bulge near said sealed aperture.

16. A means of applying pressure to prevent a vertical cylindrical container side wall from bulging near a sealed aperture, said sidewall being plastic and exhibiting a tendency to deform outwardly under stress near said sealed aperture, as when the weight of a fluidous material exerts an outward hydrostatic pressure on said side wall, said means comprising;

(a) a pair of generally vertically oriented load-bearing means which abut said tank wall surface at locations to the right and to the left of said sealed aperture, each said load-bearing means being capable of uniformly distributing concentrated applied forces over its length to said container wall; and (b) at least one tension-bearing means positioned circumjacent to said container wall and held away from said cylindrical surface, which is defined by said container side wall, by said load-bearing means so that said tension-bearing means exerts an inward force on said load-bearing means that is sufficient to counteract the internal pressure that tends to bulge the area around said sealed aperture.

17. The means defined in claim 16 wherein (a) at least one said tension-bearing means has at least two ends and does not pass across said load-bearing means but rather one said end attaches to one said load-bearing means and the other said end attaches to the other said load-bearing means; and (b) said load-bearing means are prevented from spreading apart by some connecting means which bears between said load-bearing means the tension of the tension-bearing means that is attached to each said load-bearing means.

18. The means defined in claim 17 wherein said connecting means comprises horizontal members, each said horizontal member spanning between said load-bearing means and bearing tension between said load-bearing means.

19. The means defined in claim 16 wherein said container wall comprises molded features which serve to positively locate said load-bearing means in a fixed position relative to said sealed aperture.

20. A means of applying pressure to prevent a cylindrical container side wall from bulging near a sealed aperture, said sidewall being plastic and exhibiting a tendency to deform outwardly under stress near said sealed aperture, as when an outward hydrostatic pressure is exerted on the inner surface of said side wall, said means comprising;

(a) A load-distributing means positioned adjacent to said sealed aperture and abutting the exterior of said sidewall, said load-distributing means being capable of distributing concentrated forces exerted on said load-distributing means to said sidewall in a uniform fashion, in a direction perpendicular to said sidewall, and in an area directly adjacent said sealed aperture; and (b) At least one tension-bearing means positioned circumjacent to said container wall and held away from said cylindrical surface, which is defined by said container sidewall, by said load-distributing means so that said tension-bearing means exerts an inward force on said load-distributing means that is sufficient to counteract the internal pressure that tends to bulge the area around said sealed aperture.

* * * * *